US005612585A

United States Patent [19]

Verschueren

[11] Patent Number: 5,612,585

[45] Date of Patent: Mar. 18, 1997

[54] HIGH-PRESSURE DISCHARGE LAMP AND HEAT SHIELD FOR SUCH A LAMP

[75] Inventor: Patrick Verschueren, Turnhout, Belgium

[73] Assignee: U.S. Philips Corporation, New York, N.Y.

[21] Appl. No.: 461,456

[22] Filed: Jun. 5, 1995

[30] Foreign Application Priority Data

Jun. 7, 1994 [EP] European Pat. Off. ..... 94201619

[51] Int. Cl.[6] ..... H01J 7/24

[52] U.S. Cl. ..... 313/44; 313/25

[58] Field of Search ..... 313/25, 27, 42, 313/44, 47, 634, 626

[56] References Cited

U.S. PATENT DOCUMENTS

| | | | |
|---|---|---|---|
| 3,333,132 | 7/1967 | Edris et al. | 313/47 |
| 3,723,784 | 3/1973 | Sulcs et al. | 313/27 |
| 4,034,252 | 7/1977 | McVey | 313/625 |
| 4,061,939 | 12/1977 | Strok, Jr. | 313/25 |
| 4,651,047 | 3/1987 | Liebe | 313/25 |
| 4,651,048 | 3/1987 | Liebe | 313/25 |
| 5,173,632 | 12/1992 | Dolan et al. | 313/25 |

*Primary Examiner*—Brian Zimmerman
*Assistant Examiner*—Michael Day
*Attorney, Agent, or Firm*—Brian J. Wieghaus

[57] ABSTRACT

A high-pressure discharge lamp provided with a discharge tube with a current lead-through member passing through an end of the discharge tube and provided with a heat shield around the end of the discharge tube. Also claimed is a heat shield suitable for use in a high-pressure discharge lamp. The heat shield comprises a bottom surface provided with tongues which are separated by incisions and which rest against the current lead-through member with a clamping force, in which position the tongues extend from the common bottom surface in a direction away from the discharge tube.

10 Claims, 2 Drawing Sheets

HIGH-PRESSURE DISCHARGE LAMP AND HEAT SHIELD FOR SUCH A LAMP

BACKGROUND OF THE INVENTION

This invention relates to a high-pressure discharge lamp provided with a discharge tube with a current lead-through member through an end of the discharge tube, and provided with a heat shield around the end of the discharge tube. The invention also relates to a heat shield suitable for use in a high-pressure discharge lamp as described above.

A lamp of the kind mentioned in the opening paragraph is known under the designation Philips SON-T Comfort 400 W. The heat shield serves to influence the heat balance of the discharge tube (d.t.) so that a desired temperature prevails at the area of the d.t. end during nominal lamp operation. The temperature at the area of the d.t. end, called cold spot temperature $T_{kp}$ hereinafter, determines the pressure of filling ingredients present in excess quantity in the discharge tube during lamp operation.

The heat shield in the known lamp is constructed as an Nb strip which is fastened to an Nb bush of the current lead-through member by means of an Nb rod. The heat shield narrowly surrounds the end of the discharge tube. The Nb rod ensures that the Nb strip is fixed relative to the discharge tube end.

The known construction has the major disadvantage that the Nb rod must be welded both to the Nb strip and to the Nb bush for fastening the Nb strip. In practice, in the manufacture of large numbers of lamps, this leads to a considerable spread in the fixed positions of the heat shields, and thus to a spread in $T_{kp}$. In addition, this fastening is a comparatively labour-intensive operation which does not lend itself readily to mechanization. Bush-shaped heat shields have been proposed in the literature, where the current lead-through member projects through the bottom of the bush-shaped shield and where the shield is fastened to the current lead-through member by means of a welded or soldered joint. Although a welded or soldered joint need be made in a single location only in this construction, the problem of spread in the positions remains unaffected.

SUMMARY OF THE INVENTION

It is an object of the invention to provide a measure for improving the lamp construction such that the spread in the fixed positions is limited as much as possible.

This object is realised in a lamp according to the invention in that a lamp as described in the opening paragraph is characterized in that the heat shield comprises a bottom surface provided with tongues defined by incisions, which tongues bear with clamping force on the current lead-through member and leave the common bottom surface in a direction away from the discharge tube.

A lamp according to the invention has the advantage that the heat shield is provided in a simple and self-retaining manner, whereby an accurate positioning is strongly promoted and a spread in $T_{kp}$ is effectively counteracted. Since the provision of the heat shield merely involves passing of the shield over the current lead-through member, not only this part of lamp manufacture is strongly simplified. Indeed, it facilitates a further improvement in the efficiency of the lamp manufacturing process.

A further advantage of the construction according to the invention is that the heat shield has a larger effective surface area thanks to the presence of the tongues, as compared with the known lamp. Accordingly, a smaller height of the heat shield can suffice in a lamp according to the invention compared with a similar known lamp.

The construction according to the invention is so robust that the heat shield can surround the end of the discharge tube with clearance. This promotes a unified degree of influence on the heat balance in different lamps of the same type.

If the discharge tube of the lamp has a ceramic wall, the bottom surface of the heat shield is provided with at least three tongues separated by incisions. The term "ceramic wall" in the present description and claims is understood to mean a wall of a gastight crystalline metal oxide (for example, sapphire, polycrystalline $Al_2O_3$, YAG), or metal nitride (for example, AlN). In a preferred embodiment of the lamp according to the invention, the bottom surface is provided with four tongues which are arranged mutually symmetrically. If the discharge tube has a hard-glass or quartz glass wall and is provided with a pinch at the area of the current lead-through-member, the bottom surface of the heat shield comprises two tongues preferably defined by incisions.

A heat shield suitable for use in a high-pressure discharge lamp according to the invention comprises a bottom surface provided with tongues which are situated in the bottom surface and defined by incisions. It is advantageous in that case when each tongue has a free end and the free ends together with the incisions form a boundary of a void in the bottom surface. This facilitates the operation of passing the heat shield over the current lead-through member. To realise the desired clamping force between the current lead-through member and the heat shield, the boundary of the void, in as far as it is formed by the tongue ends, should be chosen to be slightly smaller than the cross-section of the current lead-through member.

Suitable materials for the heat shield are inter alia Mo, Ta, Nb, Ti, W, and Zr.

BRIEF DESCRIPTION OF THE DRAWINGS

The above and further aspects of the invention will be explained in more detail with reference to a drawing of an embodiment of a lamp according to the invention. In the drawing:

FIG. 1 shows a high-pressure discharge lamp provided with a discharge tube 3 with a current lead-through member 40, 50 which is passed through an end 34, 35 of the discharge tube. The discharge tube is enclosed in an outer envelope 1 which is provided with a lamp cap 2 at an end. The discharge tube is provided with internal electrodes 4, 5 between which a discharge extends in the operational state of the lamp. Electrode 4 is connected via current lead-through member 40 to a current conductor 8 which in its turn is connected to a first electrical contact which forms part of the lamp cap 2. Electrode 5 is connected via current lead-through member 50 to a current conductor 9 which in its turn is connected to a second electrical contact of the lamp cap 2. The discharge tube is further provided with a heat shield 14, 15 around each end 34, 35 of the discharge tube. Each heat shield 14, 15 comprises a bottom surface which is provided with tongues which are defined by incisions and which rest with clamping force against the current lead-through member 40, 50.

FIG. 2 shows the end 34 of the discharge tube 3 in more detail. Reference numeral 140 in FIG. 2 denotes the bottom surface of the heat shield 14. Tongues 14 1 rest with clamping force against the current lead-through member 40 at 142 and extend from the common bottom surface 140 in a direction away from the discharge tube.

Figure 1:
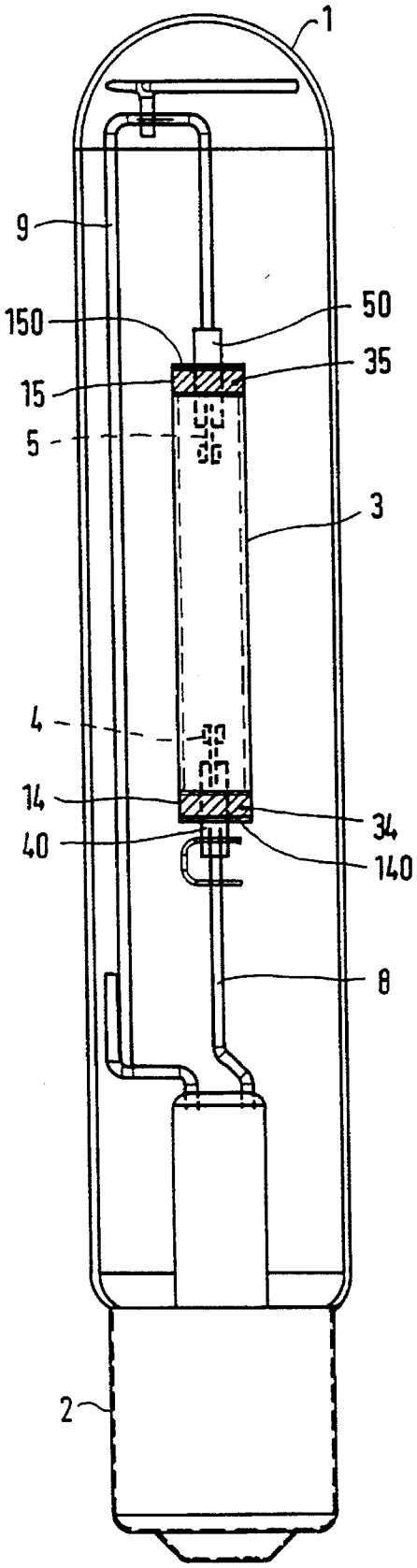
FIG. 1 is an elevation of a lamp according to the invention.
Figure 2:
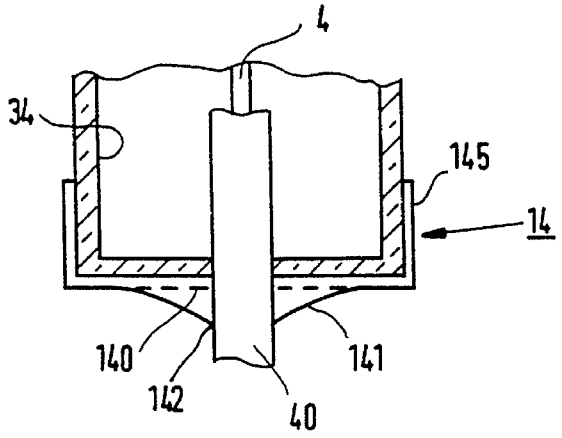
FIG. 2 shows an end provided with a heat shield of a discharge tube of the lamp of FIG. 1.
Figure 3:
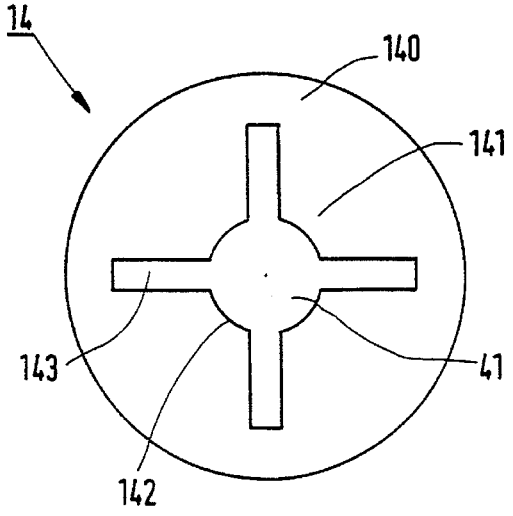
FIG. 3 is a bottom view of a heat shield for use in the lamp of FIG. 1.

In the bottom view of a heat shield for use in the lamp of FIG. 1 as shown in FIG. 3, it is visible that the tongues 141 lying in the bottom surface 140 are all limited and mutually separated by incisions 143. Free ends 142 of the tongues together with the incisions form a boundary of a void 41 in the bottom surface. During lamp manufacture, the heat shield is passed over the relevant current lead-through member with the void 41, whereby the free ends 142 of the tongues 141 leave the bottom surface plane 140 and thus clamp themselves against the current lead-through member, whereby at the same time an accurate positioning is facilitated.

Figure 4:
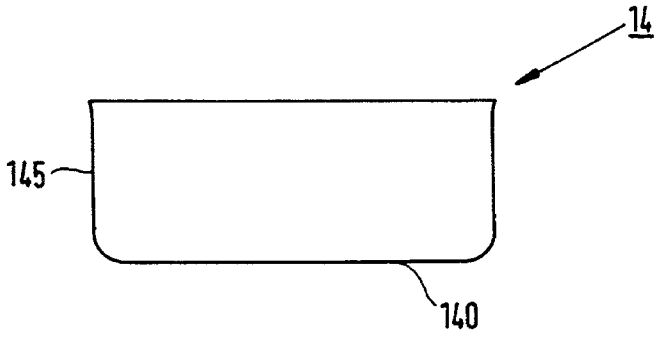
FIG. 4 is a cross-section of the heat shield of FIG. 3.

In the cross-section of the heat shield of FIG. 3 as shown in FIG. 4, it is visible that the heat shield has a raised portion 145 which is closed off at one side by a bottom surface 140.

A practical embodiment of the lamp described is a high-pressure sodium lamp which has a ceramic discharge tube of densely sintered polycrystalline $Al_2O_3$ with a filling which comprises mercury in excess, sodium in excess, and also xenon as a buffer gas. This lamp has a power rating of 400 W. The discharge tube has an external diameter of 12.5 mm and a length of 79 mm. The electrode interspacing is 40 min. The discharge tube is provided at each end with a heat shield made of Mo with an external diameter of 13.35 mm and a raised portion with a height of 5.5 min. The bottom surface is provided with four tongues separated by incisions of 1 mm wide and 3.2 mm long each. The void bounded by the tongue ends and the incisions has a diameter of 3.8 mm. The discharge tube has a current lead-through member formed by an Nb bush with an external diameter of 4 mm at either end. In the mounted state of a heat shield, the tongue ends have moved away from the bottom surface over a distance of 1.5 mm in a direction away from the discharge tube.

I claim:

1. A high-pressure discharge lamp comprising: a discharge tube having a current lead-through member which passes through an end of the discharge tube, and a heat shield around the end of the discharge tube, wherein the heat shield comprises a bottom surface provided with a plurality of tongues defined by a plurality of incisions, which tongues bear with a clamping force on the current lead-through member and extend from the common bottom surface in a direction away from said end of the discharge tube.

2. A lamp as claimed in claim 1, wherein the discharge tube comprises a ceramic wall, and the bottom surface of the heat shield comprises at least three tongues separated by the incisions.

3. A lamp as claimed in claim 1, wherein the discharge tube comprises a hard-glass or quartz glass wall provided with a pinch at the area of the current lead-through member, and the bottom surface of the heat shield comprises only two tongues defined by the incisions.

4. A high-pressure discharge lamp as claimed in claim 1 wherein said tongues have free ends which, together with the incisions, define an opening in the bottom surface of the heat shield, which opening is slightly smaller than the outer surface of the current lead-through member.

5. A high-pressure discharge lamp as claimed in claim 1 wherein said bottom surface has a circular configuration with a wall portion extending therefrom so as to surround said end of the discharge tube, and said incisions extend in a radial direction within said bottom surface and define a circular opening in the center of the bottom surface, and said tongues are bent out of the plane of the bottom surface in a direction away from said wall portion.

6. A heat shield for use in a high-pressure discharge lamp including a discharge tube having a lead-through conductor extending through an end of the discharge tube, wherein the heat shield comprises:

a wall portion shaped to enclose the end of the discharge tube and a bottom surface with radial incisions therein that define a plurality of flexible tongues adapted to apply a clamping force to a lead-through conductor of a high-pressure discharge lamp.

7. A heat shield as claimed in claim 6, wherein each tongue has a free end, and the free ends together with the incisions form a boundary of an opening in the bottom surface.

8. A heat shield as claimed in claim 7 wherein the opening is circular and has a diameter slightly smaller than the cross-section dimension of a lead-through conductor whereby, when the heat shield is clamped to the lead-through conductor, the tongues extend out of the plane of the bottom surface of the heat shield.

9. A heat shield as claimed in claim 7 wherein the opening in the bottom surface is slightly smaller than an outer surface of the lead-through conductor and the tongues are flexible enough to bend out of the plane of the bottom surface of the heat shield but rigid enough to exert a clamping force on a lead-through conductor sufficient to clamp the heat shield in a fixed position on the lead-through conductor.

10. A heat shield as claimed in claim 6 wherein said bottom surface comprises at least 3 tongues separated by the incisions.

* * * * *